US007596919B1

(12) United States Patent
Vande Hey et al.

(10) Patent No.: US 7,596,919 B1
(45) Date of Patent: Oct. 6, 2009

(54) LIGHTWEIGHT COMPOSITE ROOFING TILES

(76) Inventors: Robert Vande Hey, N. 6539 Harrison Rd., Hilbert, WI (US) 54129; Billibob J. Boor, N. 9573 Otte Ct., Appleton, WI (US) 54915

( * ) Notice: Subject to any disclaimer, the term of this patent is extended or adjusted under 35 U.S.C. 154(b) by 866 days.

(21) Appl. No.: 10/688,772

(22) Filed: Oct. 18, 2003

Related U.S. Application Data

(60) Provisional application No. 60/419,584, filed on Oct. 18, 2002.

(51) Int. Cl.
*E04D 1/00* (2006.01)
*B44F 9/04* (2006.01)

(52) U.S. Cl. ..... 52/533; 52/314; 52/555; 52/558; 52/630

(58) Field of Classification Search ..... 52/311.1, 52/533, 542, 540, 521, 555, 541, 314, 554, 52/557, 558, 630
See application file for complete search history.

(56) References Cited

U.S. PATENT DOCUMENTS

| | | | | | |
|---|---|---|---|---|---|
| 592,474 | A | * | 10/1897 | Merrill | 52/533 |
| 1,124,001 | A | * | 1/1915 | Elzey | 52/533 |
| 1,226,888 | A | * | 5/1917 | Hughes et al. | 52/536 |
| 1,740,217 | A | * | 12/1929 | Batcheller | 52/542 |
| 1,840,537 | A | * | 1/1932 | Siebenlist | 52/674 |
| 2,002,244 | A | * | 5/1935 | Kremper | 52/521 |
| 2,482,835 | A | * | 9/1949 | Bremer | 52/533 |
| 4,035,536 | A | * | 7/1977 | Morrison | 428/118 |
| 4,203,268 | A | * | 5/1980 | Gladden et al. | 52/630 |
| 4,787,190 | A | * | 11/1988 | Papsdorf | 52/553 |

FOREIGN PATENT DOCUMENTS

CH 603965 A5 * 8/1978

* cited by examiner

*Primary Examiner*—Robert J Canfield
*Assistant Examiner*—Christine T Cajilig
(74) *Attorney, Agent, or Firm*—Boyle Fredrickson S.C.

(57) ABSTRACT

A composite roofing tile with multiple tile images is adapted for presentation of the individual tile images in a non-repeating manner, and for interlocking with adjacent stacked and installed tiles.

20 Claims, 6 Drawing Sheets

TYP
24
24a
26
30
32
34
36
38
44
44a
44b
46
48
50
52
58
60
62
10
14
16
18
20
22
"D"

LIGHTWEIGHT COMPOSITE ROOFING TILES

CROSS-REFERENCES TO RELATED APPLICATIONS

This application claims priority to U.S. Provisional Patent Application Ser. No. 60/419,584, filed Oct. 18, 2002.

REFERENCE TO SEQUENCE LISTING, TABLE, OR COMPUTER PROGRAM LISTING APPENDIX SUBMITTED ON A COMPACT DISC

N/A

STATEMENT REGARDING FEDERALLY SPONSORED RESEARCH OR DEVELOPMENT

N/A

BACKGROUND OF THE INVENTION

1. Field of Invention

The present invention relates to roofing tiles of a type typically used on residential and other non-industrial buildings. More particularly, the invention relates to lightweight roofing tiles that are molded from a plastic-composite material to simulate conventional tiles and certain types of shingles.

2. Description of Prior Art

Roofing tiles and shingles are available in a variety of styles and materials. Conventional roofing tiles are typically concrete, clay or ceramic tiles provided in many styles, such as Roman or Spanish-S style. Specialty-type shingles include slate and cedar shake shingles. Such tiles and shingles generally offer longer life and less maintenance potential as compared with asphalt shingles, and they provide opportunities for unique and exotic roofing aesthetics not available with asphalt shingles. However, conventional roofing tiles and specialty-type shingles suffer from several drawbacks and disadvantages. In general conventional roofing tiles are relatively heavy, and they are not easily stacked for transportation to the job site or for carrying from the ground to the roof. The tiles must often be hand stacked and securely bound for transportation, and the heavier tiles must be carried to the roof a few at a time, or with the use of large material handling equipment. The unit cost of slate and shake shingles is relatively high. Thicker pieces of slate provide a better quality roof, but unit, handling and installation costs increase as the thickness of the slate increases. The unit cost of concrete tile is typically less than slate and shake shingles, but the concrete tiles are also typically heavier, resulting in higher handling and installation costs. Roofing tiles and specialty shingles also require special installation procedures specific to the tile and shingle configuration and type. Consequently, the installed cost of conventional roofing tiles, and slate and shake shingles, is relatively high due to high unit costs, and/or the high cost of labor to handle and install the tiles and shingles. As a result of these and other drawbacks and disadvantages known through the roofing industry, use of conventional roofing tiles and specialty shingles is typically limited to installation on relatively expensive buildings.

Prior roofing tiles and shingles made from plastic-composite materials have attempted to address some of the above-noted disadvantages of such conventional roofing materials. Composite roofing tiles are generally lightweight, and therefore, present the opportunity to reduce costs associated with handling and installation of relatively heavy conventional tiles and slate shingles. However, many prior composite roofing tile and shingle configurations are fabricated as "copies" of conventional tiles and shingles. Except for weight reduction in certain configurations, such prior composite tiles and shingles suffer from many of the same stacking, transportation, handling and installation difficulties as conventional tiles and shingles. The installed cost of such composite roofing materials is also relatively high. The unit cost of composite tiles and shingles is typically higher than the cost of tiles and shingles made from conventional materials, and when individual tiles and shingles are installed, the labor installation cost is the same as for installation of conventional roofing materials. In addition, prior composite roofing tiles and shingles often discolor in visibly evident patterns due to extended exposure to sun and weather. This discoloration results from the composition of the plastic-composite material, the molding process, and/or the configuration of the tiles. Visually detectable discoloration is often associated with uniform reinforcing or molding structures formed on the underside of the tiles or shingles, causing uniform patterns of regular transitions between thick and thin sections of the pieces that discolor non-uniformly upon extended exposure to outside elements. Due to the high cost of molds, fabrication of prior composite roofing tiles and shingles is typically limited to only a few configuration images. As a result, installation of such composite materials is often visibly evident due to the repeating image patterns as installed onto a roof, and the subsequent discoloration of the tiles and shingles. Prior composite roofing tiles and shingles also typically have difficulty meeting requirements for resistance to wind uplift as designated for roof construction in certain geographic areas of the country. As a result of the above-identified and other known disadvantages, prior composite roofing tiles and shingles have meet with only limited success in the market place, and the bulk of the roofing sold continues to be made from conventional materials.

SUMMARY OF THE INVENTION

The primary objective of the present invention is to provide a new and improved composite roofing tile that is adapted for presentation of conventional roofing tiles and shingles, and that addresses the above-identified drawbacks and disadvantages of prior roofing tiles and shingles made from both conventional and composite materials.

An important objective of the invention is to provide a roofing tile that is molded from plastic-composite material to obtain a lightweight, yet durable roofing tile.

Another important objective of the invention is to provide a composite roofing tile that includes multiple tile or shingle images on a single tile board. This aspect of the invention results in reduced handling and installation time and labor as compared with time and labor associated with conventional single-image tiles and shingles, and enables potential enhanced pattern randomness for installed tiles and shingles using the same number of mold cavities.

Another important objective of the invention is to provide a composite roofing tile that is configured to present multiple tile and shingle images as individual images rather than as multiple connected images. This aspect of the invention assists in further achieving an installed roof with no readily visible repetition of image patterns on the roof.

Another important objective of the invention is to provide a composite roofing tile that is suitable for provision of alternate types of images, such as slate and shake shingles, Roman or Spanish-S tiles, and other tile and shingle configuration images on the same basic configuration tile board. This aspect of the invention results in a reduction of design and manufacturing costs, simplification of installation procedures with a single basic installation procedure for the multiple tile image configurations for reduction in installation time and costs, and improved selection choices for the consumer, including up to the time the tile is actually installed onto a roof.

Another important objective of the invention is to provide a composite roofing tile that is installable with standard, variable or uniformly changing graduated vertical exposure, as desired.

Another important objective of the invention is to provide a composite roofing tile that is configured for ease of stacking and handling. This aspect of the invention results in improved ease and cost reduction of transportation to the job site, and from the ground to the roof. Roofing tiles can be stacked for shipping, and for carrying stacked multiple tiles at one time from the ground to the roof, regardless of the specific tile or shingle images formed in the tile.

Another important objective of the invention is to provide a composite roofing tile that is configured for interlocking engagement with adjacent tiles when being stacked and handled, as well as when installed onto a roof. This aspect of the invention further enhances ease of handling and installation procedures.

Another important objective of the invention is to provide a composite roofing tile that does not discolor in visibly evident patterns from extended exposure to sun and weather when installed on a roof.

Another important objective of the invention is to provide a composite roofing tile that is fabricated with multiple image patterns on the tile board, resulting in further reduction of visibly evident repeating patterns in an installed roof.

Another important objective of the invention is to provide a composite roofing tile that provides reliable, long installed life, thereby contributing to reduced life-cycle costs.

Another important objective of the invention is to provide a composite roofing tile with improved resistance to wind uplift as compared with prior composite roofing tiles and shingles, and that is capable of meeting such requirements as may be specified in certain locations in the country.

Another important objective of the invention is to provide a composite roofing tile that, in implementation of the above objectives, and despite the typically high unit cost of composite roofing tiles and shingles, results in an installed roof at less cost than both conventional roofing tiles and specialty shingles, and prior composite roofing tiles and shingles.

These and other objectives and advantages of the invention will become more apparent from the following detailed description when taken in conjunction with the accompanying drawings.

A preferred embodiment roofing tile according to the invention is formed as a generally rectangular board, with two or more tile or shingle images formed side by side in the board. The board is formed with side and top weather locks, and support structure to establish an air space between the tile and the roof deck. Non-uniform reinforcing ridges are formed on the underside of the tile images so that, even if the tiles discolor, the images will not discolor in parallel or visibly evident repeating lines. The tiles are configured to interlock when stacked together for shipping, handling and stacking on the roof to reduce packaging materials and on-site disposal of such materials. The tiles are also configured for self-adjusting, self-centering in side-to-side relation with adjacent tiles as installed on the roof.

Among the further advantages of roofing tiles in accordance with the invention, the rectangular board provides ease of handling and ease of roof layout by the installer. Multiple tile or shingle images per tile (i.e., composite tile board) reduces the number of pieces the installer handles. The weather locks allow for contraction and expansion of the tiles due to temperature changes and deflections in the roof deck, and they provide enhanced weatherproof characteristics as compared with conventional tiles and recent synthetic shingles.

BRIEF DESCRIPTION OF THE DRAWINGS

FIGS. 13-17 are views of a composite trim piece for use with the tiles.

Figures 1, 2, 3, 4, 5:
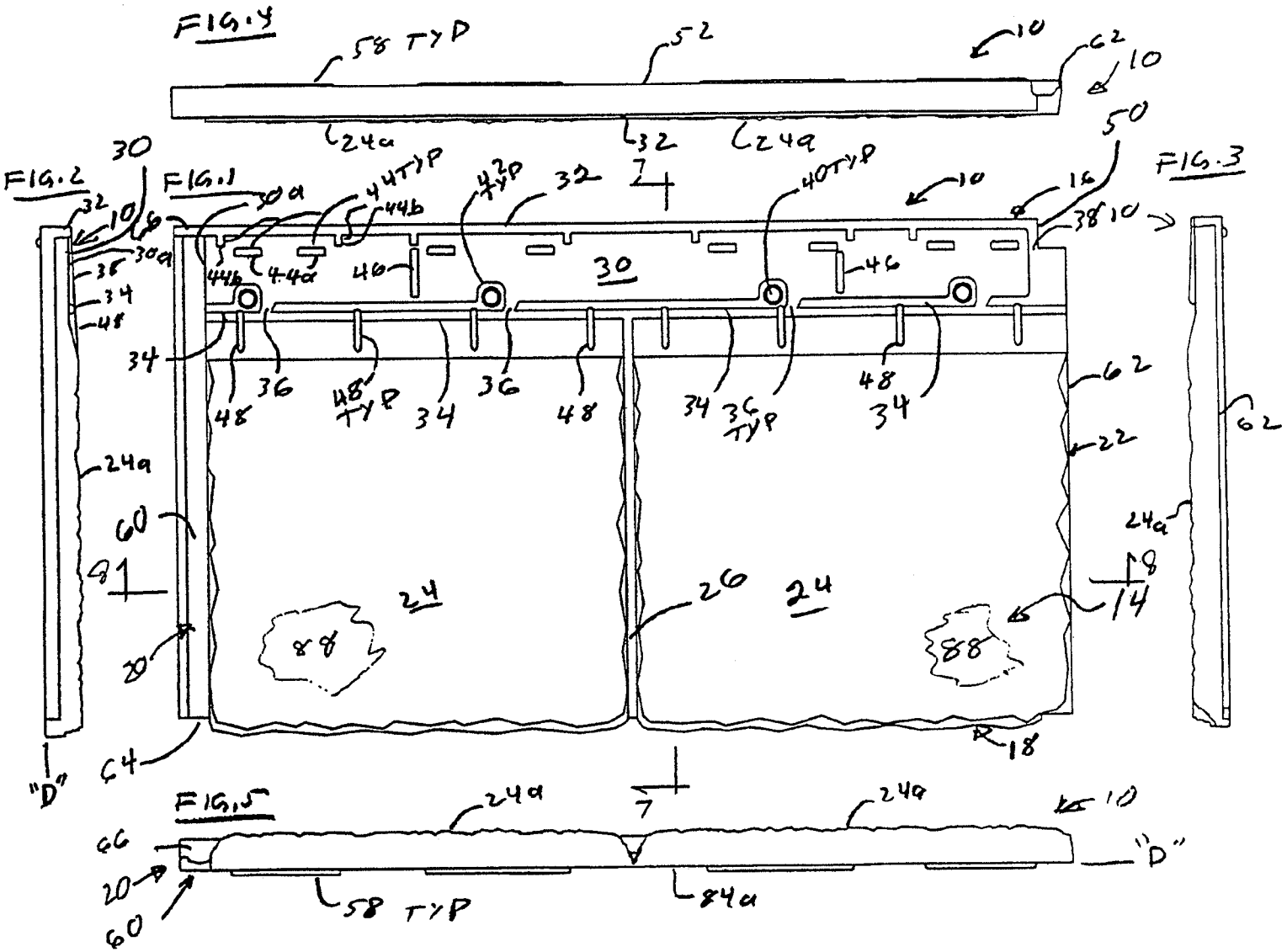
FIG. 1 is a front view of a roofing tile incorporating the unique aspects of the present invention.
FIGS. 2 and 3 are left and right side views, respectively, of the roofing tile shown in FIG. 1.
FIGS. 4 and 5 are top (head lap end) and bottom (nose end) views, respectively, of the roofing tile.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

Reference numerals shown in the drawings correspond to the following:

| | |
|---|---|
| 10 | Roofing tile with slate images |
| 12 | Roof |
| 14 | Image section |
| 16 | Head lap |
| 18 | Nose end |
| 20 | Waterlock |
| 22 | Overlap side |
| 24 | Slate images |
| 24a | Slate image front surface |
| 24b | Slate image back side |
| 26 | Visually distinct center of image section (divider between images) |
| 28 | Random pattern, non-uniform image reinforcing ribs |
| 28a | bottom surfaces of ribs 28 |
| 30 | Shelf |
| 74 | Tapered walls |
| 76 | Center root of channel |
| 78a | Inner side of channel |
| 78b | Outer side of channel |
| 80 | Root of groove |
| 82a | Inner side of groove |
| 82b | Outer side of groove |
| 84a | Datum surface - head lap |
| 84b | Datum surface - right side |
| 84c | Datum surface - left side |
| 84d | Datum surface - nose |
| 84e | Datum surface - center divider |

-continued

| | |
|---|---|
| 88 | Stacking regions |
| 100 | Trim piece |
| 102 | Side walls |
| 102a | Tapered sides |
| 104 | Connecting wall |
| 106 | Ends |
| 108 | Reinforcing ribs |
| 110 | Positioning/water barrier ridge |
| 112 | Fastener locations |
| 114 | Support ribs |
| 142 | Horizontal battens |
| "D" | Datum Plane |
| "H" | Stacking height |
| "V1-3" | Vertical exposures |

DETAILED DESCRIPTION OF THE INVENTION

For purposes of illustration, one embodiment of a roofing tile according to the invention is shown in the drawings as tile 10. The tile is molded, such as but not limited to with an injection or compression molding processes, with a plastic-composite material that provides characteristics of relatively high strength, resistance to discoloration from extended exposure to outside elements, and a matte finish. One preferred tile is sized at approximately 12"×24", with tile image size of approximately 10"×11½" for maximum 10" tile image vertical exposure when installed onto a roof.

The tile 10 is generally rectangular, and includes (i) a generally rectangular center image section 14, or tile image presentation area, in which tile or shingle images are formed, (ii) a head lap 16 end portion integrally associated with and extending along the top of the rectangular tile-image section, (iii) a nose 18 end portion integrally associated with and extending along the bottom of the rectangular tile-image section, (iv) a waterlock 20 integrally associated with and extending along one side, shown in FIG. 1 and herein referred to as the left side, of the rectangular tile-image section; and (v) an overlap side 22 integrally associated with extending along the side of the rectangular tile-image section opposite the waterlock, shown in FIG. 1 and herein referred to as the right side.

The tile-image section 14 is provided with a plurality of side-by-side, spaced images simulating roofing tiles or shingles established in the front surface thereof for presentation of the images forwardly when the tile is installed onto a roof. The head lap 16 and waterlock boundary formations 20 extend outwardly from the top and left side of the rectangular tile-image section 14, and the nose end 18 and side overlap boundary formations 22 are established on the back, along the bottom and right sides, of the tile-image section.

The tile-image section 14 shown is provided with a pair of laterally spaced slate images 24 having front sides 24*a* in which the slate images are formed and back sides 24*b*. A divider section 26, at the center between the two images 24 shown, is established to be visually distinct from the tile images 24, to separate the images in the image section 14. The visually distinct divider 26 extends from the top of the tile-image section 14 to proximate but slightly above the bottom of the tile images 24. The visually distinct divider 26 visually separates the tile images 24 from one another when the tile is installed on a roof 12, serves to establish separated sides of the adjacent images 24, and provides the viewer with the impression that the tile images are established with separate tiles rather than with two tile images in one tile unit 10.

The preferred visually distinct divider 26 is established by a surface that is visually similar to the side interface portion (discussed further below) that is visible between adjacent tiles 10 when installed onto a roof. In particular, the center divider 26 is visually similar in appearance, as well as in length and approximate width, to the vertical strip portion of the waterlock 20 (shown on the left side of the tile) that is exposed for viewing between two adjacent tiles when installed onto a roof. In other words, the vertical image dividers 26 visually match the dividers (i.e., the sides 20) between the image sections of adjacent installed tiles. In the embodiment shown, the center divider 26 and the exposed strip of the waterlock 20 are presented as generally flat, with approximately the same width and length. As a result of the matching center and side portions of the tiles, a viewer cannot easily detect the difference between the between the tile image dividers and the sides of the tiles 10, and thus cannot distinguish the junction between adjacent tiles. The tile looks like individual images, not two images per tile. Without this visually distinct center and matching exposed side portions, the two-image tile presentation would be visually perceptible by virtue of a differently appearing side waterlock interface between the tiles. This individual-tile image presentation is enhanced by terminating the center and associated side portions at a position above the bottoms of the tile images.

Preferred slate-image tiles 10 are formed from, for example, at least four different molds, with at least two different images 24 per mold. This results in eight entirely different images for installation onto the roof in a random, non-repetitive manner, and permits substantially enhanced variation of the images on the roof, thereby avoiding a repeating tile image pattern that would result in an artificial look on the roof. The tile image section 14 may alternately be provided with multiple, laterally positioned, images of other styles of tiles or shingles, such as shake shingles with 3, 4 or 5 cavities for varying numbers of shake images per tile, or Roman or Spanish-S tiles with, for example, three images per mold. In these instances, the tiles will include all of the features discussed herein, as applicable to the specific images presented.

Figures 6, 7, 8:
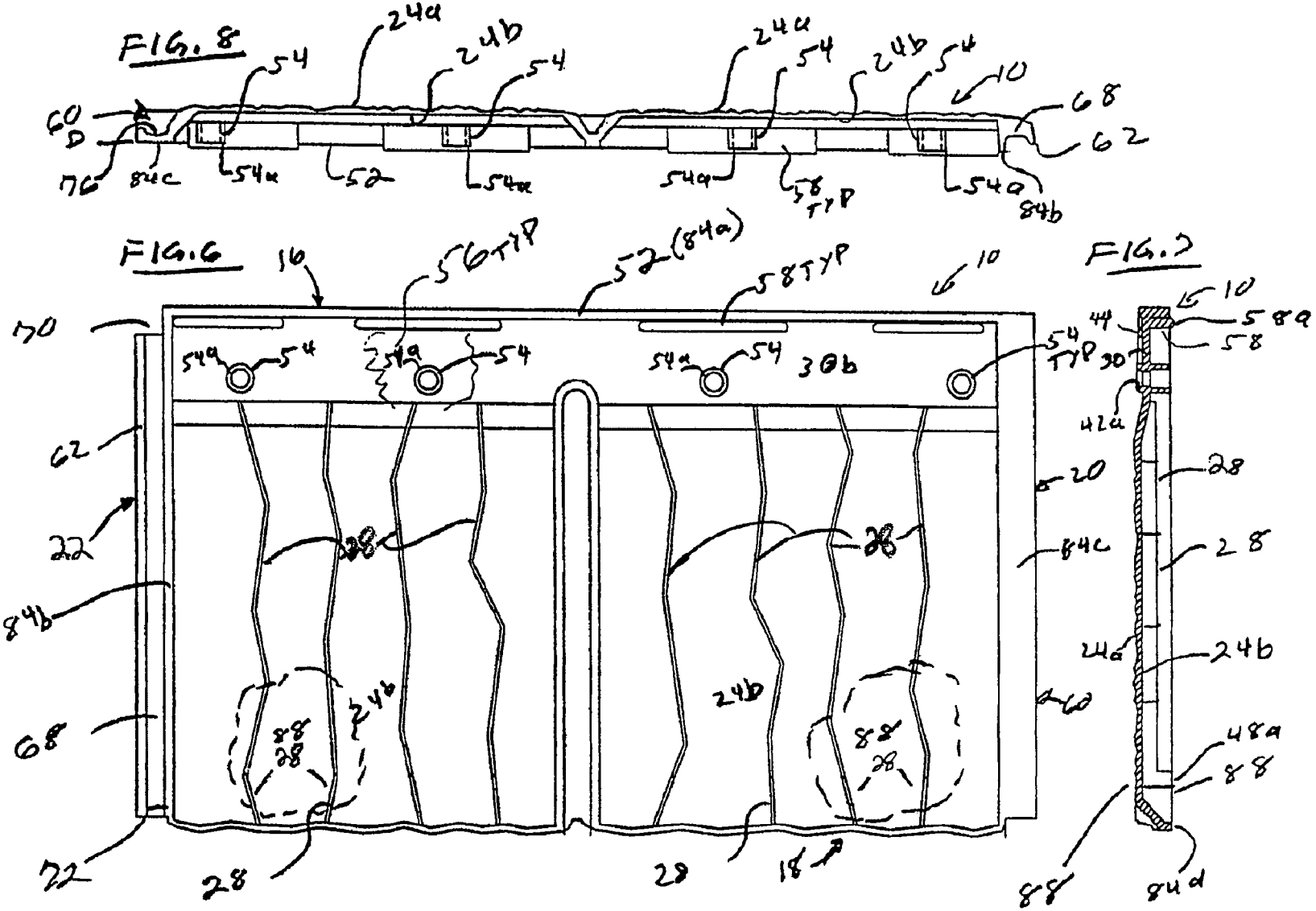
FIG. 6 is a rear view of the roofing tile.
FIGS. 7 and 8 are cross-sectional views taken substantially along the lines 7-7 and 8-8, respectively, of FIG. 1.

The backsides 24*b* of the tile images 24 are formed at a position raised forwardly from a datum plane "D" (see FIGS. 5 and 8), established by datum surfaces provided proximate the perimeter of the tile, to achieve generally hollow images as can be seen in cross-sectional views shown in FIGS. 7 and 8. Raised tile images enable provision of composite tiles that present close simulation of conventional tiles and shingles when installed on the roof. Raised tile images also enable production of tiles provided with relatively constant wall thickness, for ease of molding, and to achieve relative lightweight tiles.

The backsides 24*b* of the tile images 24 are provided with reinforcing ribs 28 that extend between the top and bottom of the images, and that are characterized as being formed as random, non-uniform, non-straight ribs. As a general rule, plastic-composite materials of the type suitable for use in roofing tiles discolor from extended exposure to weather elements. The random pattern reinforcing ribs 28 impart a unique, non-uniform discoloration characteristic to the tile images 24 in the present invention. Any discoloration that occurs will be viewed as random discoloration. This eliminates the repetitive, non-random discoloration that occurs with many prior composite tiles and shingles. In preferred embodiments, the non-uniformity, non-repetitive nature of the reinforcing ribs continues throughout all image cavities in all molds used to produce the tiles 10 in accordance with the invention. If, for example, eight different images 24 are provided in four tile 10 configuration molds, then eight different sets of non-uniform reinforcing ribs will be provided, one set of non-uniform ribs for each tile image 24. This, along with random installation of the tiles from the different mold configurations will insure a repetitive discoloration pattern does not occur on an installed roof.

One advantageous result of providing uniformly sized and configured, rectangular tiles 10 with image sections 14 as described herein is that the same basic procedure is used for installation of roofing tiles independently of the style of the specific tile or shingle image presentation to be installed. Different types of conventional tiles and shingles require different installation procedures. A common installation procedure using tiles 10 in accordance with the invention reduces the education needed for the roofer to a single installation procedure for all tile and shingle images provided. A common installation procedure therefore reduces the installation costs of the various tile and shingle images, and allows the homeowner to change the selected style even after the tile base structure has been installed, up until the tiles are actually installed onto the roof. Another advantageous result of providing uniformly sized and configured tiles with image sections as described is that a standard image vertical exposure can be provided independently of the type or style of the image, while still enabling provision of varied vertical exposure on a roof if desired. For example, a tile 10 of approximately 12"×24" in size provides a maximum vertical tile exposure of approximately 10 inches, but the vertical exposure may be decreased as desired, such as a gradient row decreased exposure as is common with conventional slate shingles, or staggered exposure between tiles installed in the same row on the roof. Conventional shake is installed at a constant 10-inch vertical exposure, but with shake images provided in a roofing tile of the present invention, the shake shingle images may be alternately installed at a different or varying vertical exposure, an installation feature that is not currently available with conventional shake shingles of prior composite shake shingles.

In general, the top head lap 16 and overlapping nose end 18 of installed rows of tiles 10 are cooperative to establish a weather-lock boundary between the rows of tiles as installed onto a roof, and the waterlock side 20 and overlapping side 22 are cooperative to establish a weather-lock along sides of adjacent installed tiles. More particularly, the head lap and waterlock side boundary formations are provided with operative elements facing forwardly from the front sides thereof when the tile is installed onto a roof (i.e., outwardly away from the roof), and the overlap side formation is provided with cooperative elements facing rearwardly from the back side thereof toward the roof.

Referring to FIGS. 1 and 2, the head lap 16 includes a generally planar shelf 30 that extends along the upper portion of the tile 10, generally parallel to the datum plane "D" of the tile, at a position below the height of the image front surfaces 24*a*, to cause water to flow from the top of the shelf toward the bottom of the shelf when the tile is installed on a roof. The right side of the shelf 30 is closed with a side-ridge water dam 38. The left side 30*a* of the shelf 30 is open for draining into a waterlock channel 60 on the left side of the tile. A top-ridge water dam 32 projects forwardly (upwardly as installed onto a roof) from the front surface of the shelf, extends along the top of the shelf, uninterrupted cooperatively between the sides of the shelf, to establish an upper water barrier along the top of the shelf and generally along the top of the tile 10. A bottom-ridge water dam and guide 34 projects forwardly from the front surface of the shelf, preferably to a height greater than the height of the top-ridge water dam 32, and at or less than the general height of the front image surfaces 24*a*, and extends along the lower portion of the shelf, generally between the shelf and the tile-image section 14. The bottom-ridge water dam and guide structure is provided with laterally spaced water exit passages 36 to establish fluid communication between the lower portion of the shelf and the top of the tile-image section 14. The bottom-ridge water dam and guide structure establishes a substantial barrier to prevent water being blown upwardly from the tile image section 14 onto the shelf of the installed tiles 10, yet provides drainage through the downwardly sloped passages 36 as installed onto a roof for such water as may be blown or otherwise accumulate on the shelf 30. The side-ridge water dam 38 is raised from the front surface of the shelf 30, and extends along the right side of the shelf to an angled height transition between the top ridge water dam 32 and the bottom ridge water dam 36 to establish a water barrier along the right side of the shelf.

Fastener locations 40 are laterally spaced and positioned proximate the bottom-ridge dam 34 along the bottom portion of the shelf 30. The fastener locations are horizontally aligned for installation of fasteners therethrough and into a roof batten or directly to the roof deck to secure the tiles onto the roof. Resistance of the tile 10 to wind uplift generally increases the closer the fastener locations are to the top of tile image section 14. The fastener locations are surrounded by fastener receiving formations comprising upper surrounding bosses 42 raised upwardly from the shelf to the height preferably of and transitioning into the bottom-ridge darn 34. The preferred surrounding upper bosses are provided with tapered countersink fastener-head receiving holes 42*a* (see FIG. 7). The upper bosses establish a water barrier between the shelf and the installation fasteners, to prevent water from seeping down along the fasteners and onto the roof deck, and thereby prevent subsequent loosing of the fastener in the roof as occurs with certain prior composite roof tile and shingle configurations. This configuration boss also enables use of both nails and threaded fasteners, and particularly provides for an improved tight fit with threaded fasteners having complimentary tapered heads resulting in additional resistance to wind uplift. Laterally spaced reinforcing ribs 48 extend vertically between the raised tile images 24 and the bottom-ridge water dam 34 to provide added rigidity and reduce flexing along the transition between the images and the bottom-ridge water dam, thus improving resistance to wind uplift during high wind conditions.

Tile stacking alignment guides 44 are located near the top of the shelf 30. The stacking alignment guides are raised upwardly from the shelf, and are positioned and spaced to define a generally surrounded area on the shelf to a height proximate the height of the top water dam 32 for position-locating receipt of tile positioning lugs 58 (discussed further below) of tile stacked thereon. The stacking alignment guides shown include a pair of laterally spaced, laterally extending guides 44*a* located below the top-ridge water dam 32 to define the lower edge of the surrounded space on the shelf, a pair of laterally spaced studs 44*b* located outwardly of the guides 44*a* and extending downwardly from the top shelf to define the sides of the surrounded space of the shelf, with the top-ridge water dam defining the top of the surrounded space.

Tile installation alignment guides 46 are also formed at the top of the tile 10 with at least one installation alignment guide associated with each of the tile images 24. The installation alignment guides are laterally spaced and positioned corresponding to proportional lateral positions of the tile images. In particular, one alignment guide 46 is shown associated with each tile image 24, and is positioned at approximately the lateral center of the associated image. The installation alignment guides 46 are useful as cutting guides, for starter tiles in those rows that begin with half-width tile images, and for installation alignment of tiles with tiles in rows therebelow that have been previously installed on the roof.

A notch 50 formed in the upper right corner of the tile is sized to receive wall 66 at the top of the channel 60 on the opposite side of an adjacent tile during installation of the tiles on a roof, and is larger from top to bottom on the tile than the closed wall 66. This permits further variation of vertical exposure of installed tiles, by permitting the installer to stagger the bottom edges of tiles in the same row on the roof.

Figure 10:
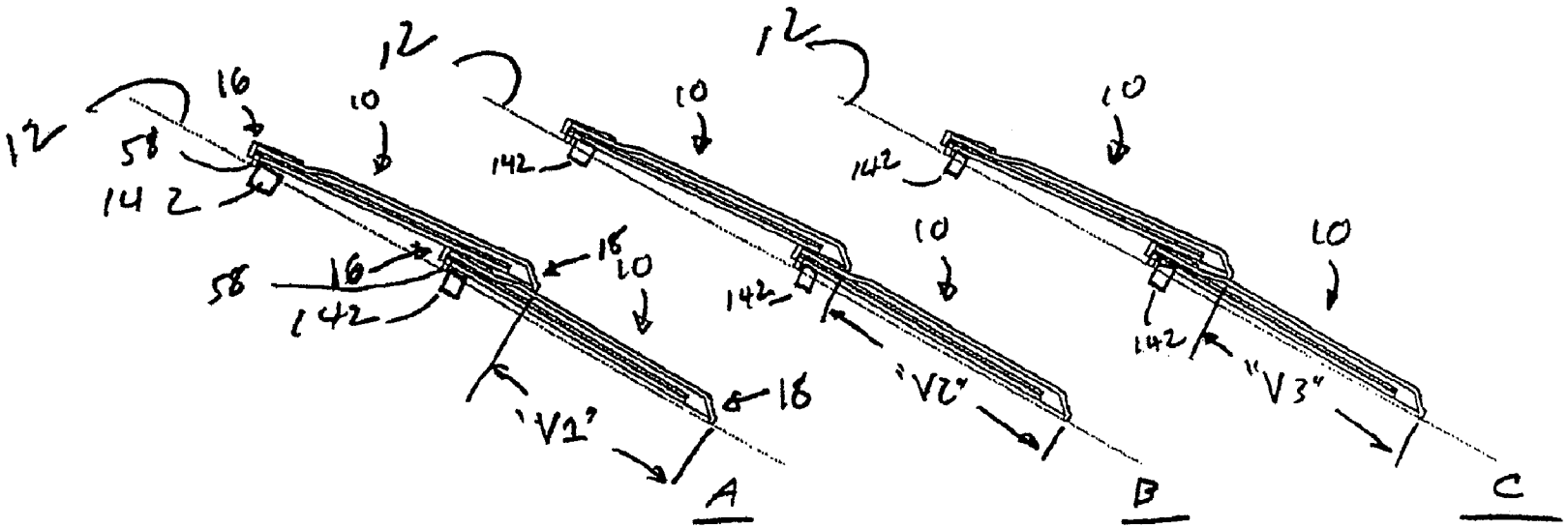
FIGS. 10A-C are side views of installed roofing tiles positioned at three different vertical tile exposures designated as V1, V2 and V3.

As best seen in FIGS. 6-8, the back side of the head lap 16 is provided with a bottom support lip 52 that extends downwardly from along the top of the tile 10, and terminates in a support edge 84*a* at the datum plane "D" along the top of the tile. The back sides of the overlapping side 22, waterlock side 20, nose end 18 and center 26 of the tile are also formed with surfaces 84*b-e*, respectively, at the datum plane. Lower support bosses 54 surrounding the fastener locations 40 and depending downwardly from the back of the shelf 30, terminate in a support edge 54*a* positioned at the datum plane "D", and optionally include additional support pad structure 56 depending downwardly from the back of the shelf to the datum plane "D". The lower support bosses 54 and optional additional support pad structure 56 engage battens 142 (such as shown in FIG. 10) on the roof, and establish direct support between the head lap 16 and battens 142 when installed thereon. Consequently, the tile will not warp or loosen as a result of installation of the fasteners, or being walked on, or from flexing of the tile-image section 14 such as from repeated exposure to high winds. Such support, with tapered-head threaded fasteners, is particularly advantageous in the tile being capable of meeting requirements for resistance to high wind uplift.

Tile positioning and stacking lugs 58 are also provided on the back side 30*b* of the head lap 16. These positioning lugs are extend laterally aligned along the upper portion of the tile, and depend downwardly from the backside of the shelf 30 to lower surfaces 58*a* positioned below the datum plane "D", to a depth sufficient to engage the top side of the battens 142 on the roof such as approximately one-fourth (¼) to one-half (½) inch as shown in FIG. 10. This results in labor savings when the tiles are installed because the installer will not need to be concerned with vertical alignment. The tiles are simply placed on the battens and slid down until the positioning lugs 58 engage the top side of the battens. The terminating edges 58*a* of the positioning lugs 58 are rounded to preclude wear of roof deck materials when the tiles are installed directly onto roof deck materials without battens. The positioning lugs 58 are also sized to be received in the surrounded space on the top of the shelf 30 as established by stacking guides 44 when the tiles are stacked for shipping and handling purposes.

The waterlock 20 and overlapping side 22 formations of the tiles 10 are complimentary and cooperative to establish a waterlock joint between the sides of adjacent installed tiles, and a self-centering, self-adjusting characteristic of adjacent tiles. The waterlock prevents water from seeping between the sides of the tiles and onto the underlying roof deck structure, and the self-adjusting overlap feature permits relative movement between the sides of the tiles as and when installed onto a roof. In establishing the side waterlock joint, a forwardly facing channel 60 extends continuously along the left side of the tile shown (see FIGS. 1, 5 and 8), and a complimentary rearwardly projecting lip 62 is provided extending continuously along the right side of the tile (see FIGS. 4, 6 and 8). The channel 60 extends from the open side 30*a* of the shelf 30 to an open bottom 64 positioned proximate but not beyond, and preferably slightly above, the bottom of the tile-image section 14, such that water will flow down the channel 60 and out the open bottom 64 onto the tile-image section 14 of the tiles installed in the row therebelow. A closed water-barrier formation 66 is established at the top of the channel 60, provided in the embodiment shown as a continuation of the top water dam 32 (see FIG. 1). The lip 62 extends along the outer right edge of the tile-image section 14, from the notch 50 in the head lap formation 16 to a position below the open bottom 64 of the channel 60 and above the bottom edge of the tile images 24. The lip 62 is established as the outer side of a rearwardly facing groove 68 that extends along the right side of the tile, from an open upper end 70 fitting proximate but below the position of top closed water-barrier 66 at the top of the channel 60 as installed with an adjacent tile, and a lower closed end 72 fitting below the open bottom 64 of the channel 60. The forwardly facing structure of the right overlapping side transitions between the tile image section 14 and the edge of the lip 62.

Figure 11:
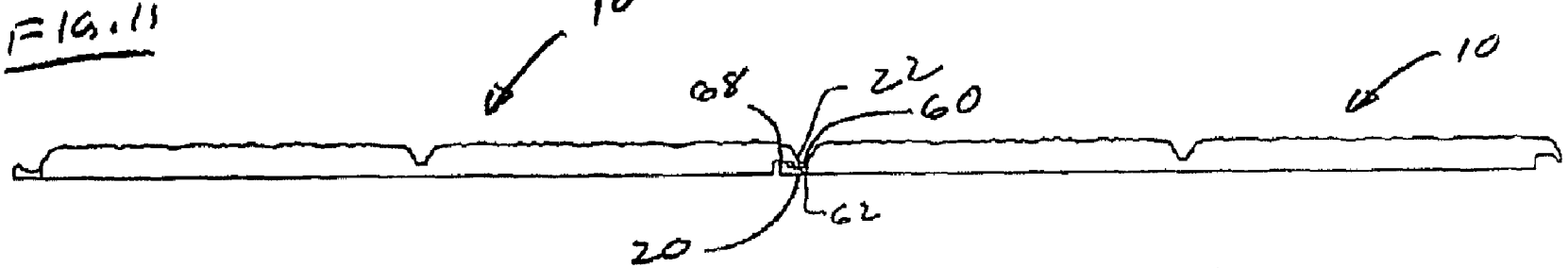
FIG. 11 is a nose-end view similar to FIG. 5 of two interlocked roofing tiles as installed onto a roof.
Figure 12:
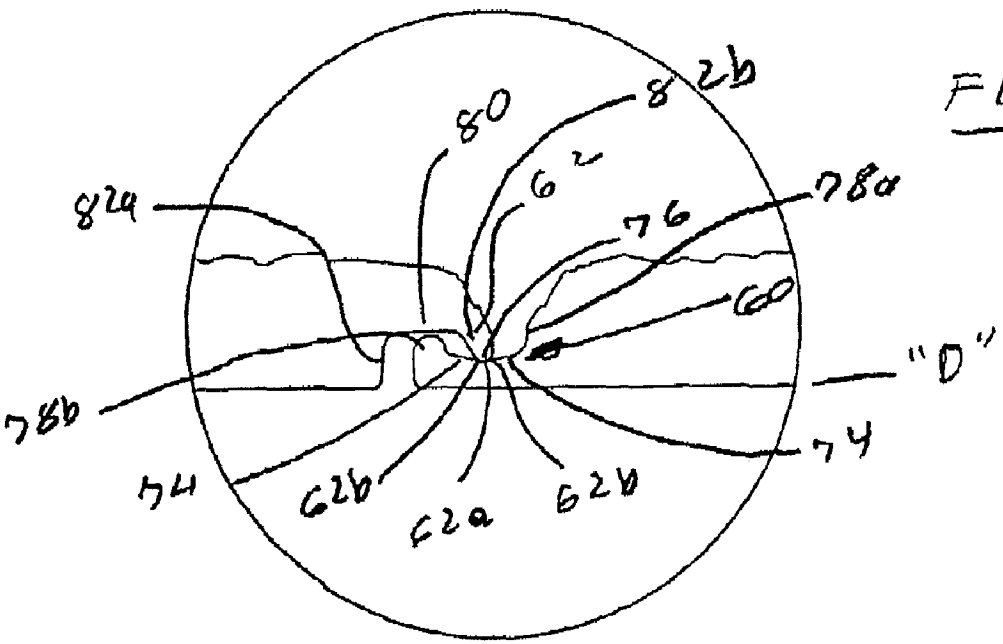
FIG. 12 is an enlarged fragmentary view of the self-centering, interlocking waterlock established between adjacent installed tiles shown in FIG. 11.
Figure 13:
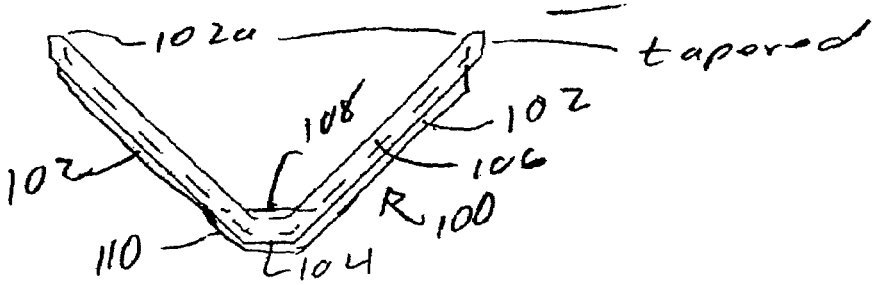
Figure 14:
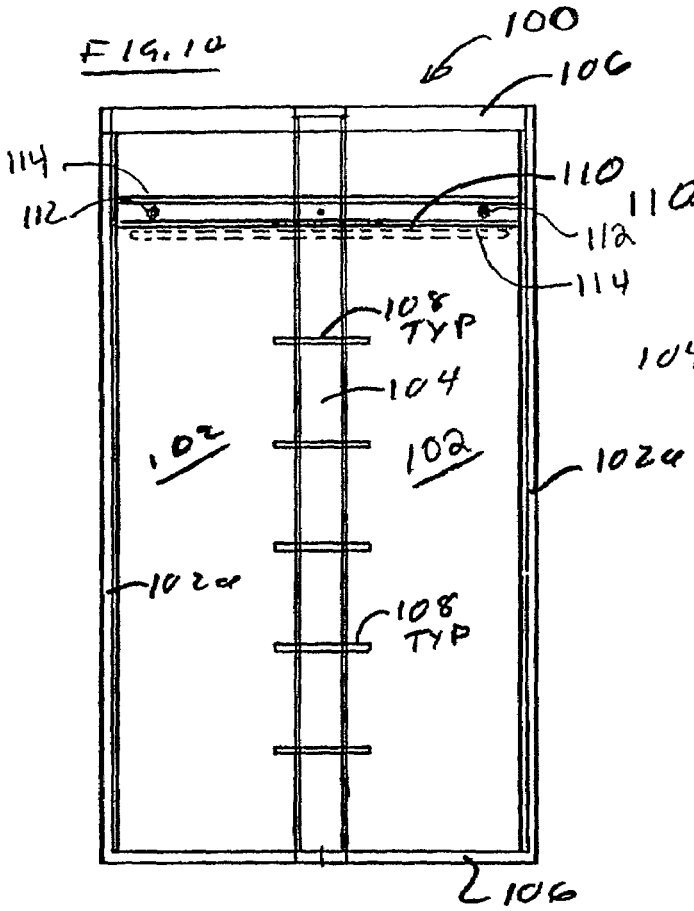
Figure 15:
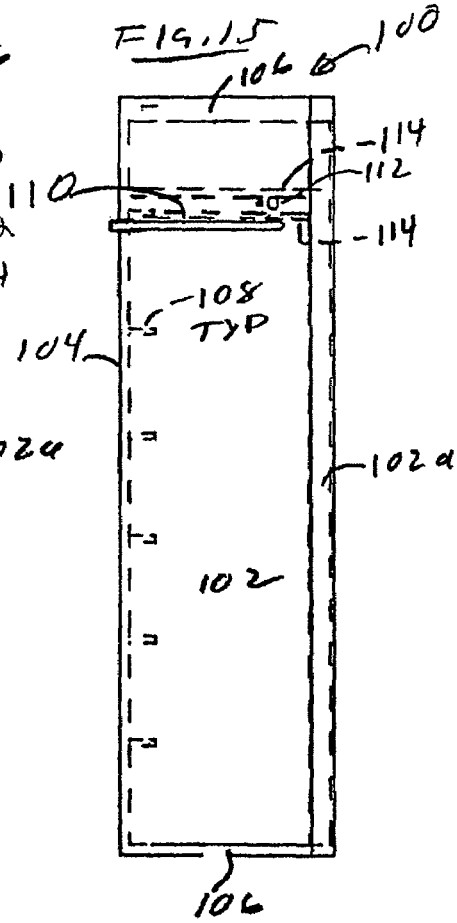
Figure 16:
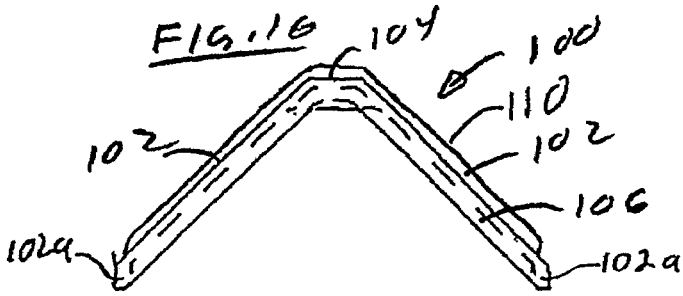
Figure 14:
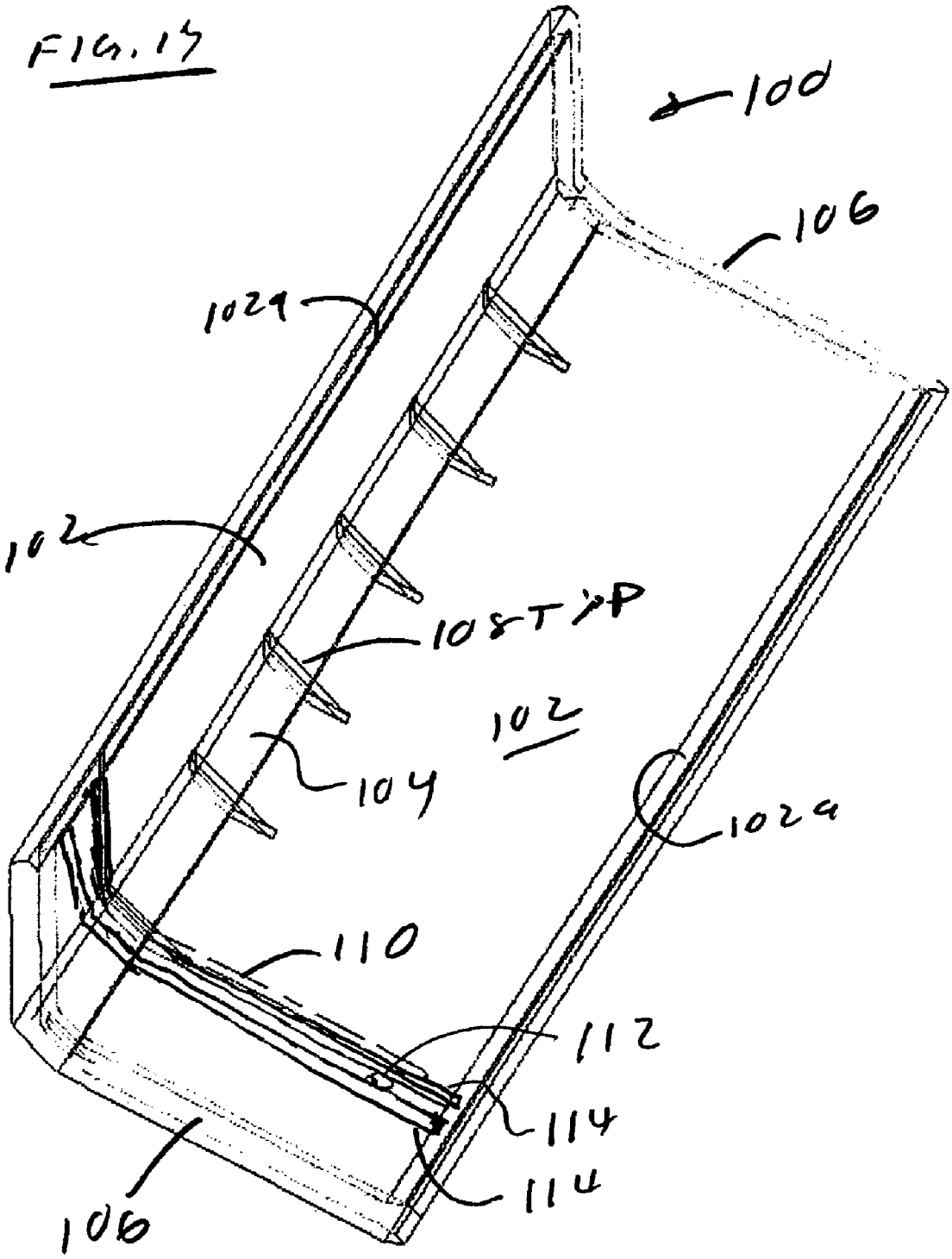

As generally shown in FIG. 11, the channel 60 and groove 68 are complimentary in size and shape such that the lip 62 is slidably received from side-to-side in the channel 60 of an adjacent tile when installed on the roof. To establish side-to-side self-centering action, the channel 60 is provided with tapered or curved walls, and the lip 62 is configured to slide sideways on the tapered walls of the channel 60 toward the center therebetween when positioned on either side in the channel. Referring to FIG. 12, the channel 60 shown is formed with a substantially homogeneous cross-section along the length thereof, established with opposing sides 78*a*, 78*b*, a root 76, and intermediate walls 74 extending between the root 76 and the sides 78*a-b*. The intermediate walls 74 slope forwardly upon progressing outwardly from the center root 76 toward the sides 78 to establish the self-centering channel 60. The inner side 78*a* of the channel 60 is established at a position generally co-planar with the visually distinct center 26 between the tile images 24, and transitions into the side of the adjacent tile image 24. The outer side 78*b* of the channel extends to a position raised above the inner side of the channel (i.e., the visually distinct center between the tile images) to establish an extended outside guide along the outer length of the waterlock channel and establish the outer waterlock barrier for water flowing in the channel. The groove 68 shown is also formed with a substantially homogeneous cross-section along the length thereof, established with a root 80, an outer side 82*b* provided by one side of the lip 62, and an inner side 82*a* having a rearwardly facing surface extending along the datum plane "D". The lower surface of the lip 62 extends generally co-planar with the center root 76 of the channel 60, and the width of the lower surface of the lip is sized for side-to-side clearance or sliding positioning in the center root of the channel. The lower edges of the lip are further provided with corner breaks or chamfers along the length thereof for general correspondence with the taper of the channel walls 74 and side-to-side sliding relation therebetween. With this arrangement, the width of the channel 60 and the width of the groove 80 are established to permit the lip 62 and channel 60 of adjacent tiles 10 to move sideways relative to one another, while maintaining the water-lock therebetween, to accommodate a change in size or position of adjacent tiles. The lip 62 slidably positioned on the taper walls 74 provides a tendency for automatic centering of the lip 62 in the channel 60.

The self-adjusting, self-centering side arrangement is tolerant of installation positioning inaccuracies, and therefore promotes ease of installation of the roofing tiles 10. Initial positioning of the tiles on the roof is not critical. The installer may be off by a dimension such as approximately ¼ inch as the tiles are laid into position, and tile will automatically self-center to the appropriate position, thus providing a labor saving feature as the installer need no longer be concerned with critical alignment as involved in the installation of many prior and conventional composite tiles and shingles. Even if vertical alignment chalk marks established on the roof, to establish horizontal spacing of the tiles, are slightly off location, the self-centering interface between adjacent tiles will result in the tiles automatically centering into the proper position on the roof. This self-adjusting, self-centering arrangement also accommodates expansion and contraction of the installed tiles due to environmental temperature changes, as well as flexing and bowing of the tiles such as from being walked on, from repeated wind conditions, and from flexing or bowing of the roof. Alternately, the self-centering, self-adjusting, side waterlock may be provided with the self-centering action established between tapered walls defined in the groove 68 and the terminal edge 62 of the channel 60 configured as a lip engaging the tapered side walls of the groove.

Figure 9:
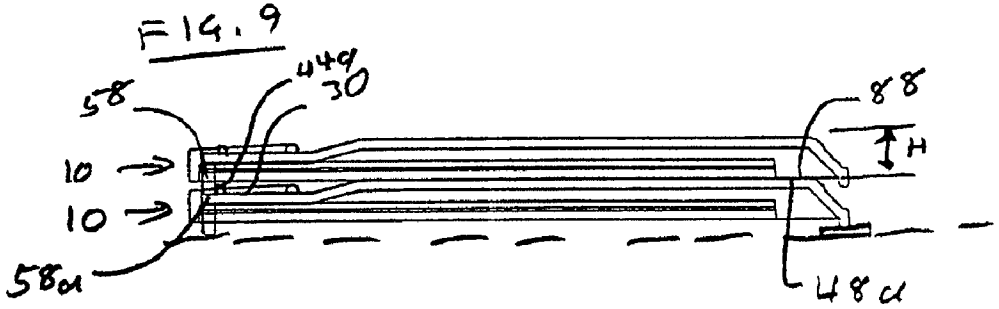
FIG. 9 is a side view of two stacked roofing tiles.

Tiles 10 in accordance with the invention are also uniquely adapted for ease of stacking and handling. In particular, the front and back sides of the tiles are provided with designated aligned locations that are spaced top to bottom and side to side, such as generally proximate the corners of the tiles, at which there is established structure for stacking of tiles and maintaining the stacked tiles in a stable, stacked, generally horizontal position. At such designated stacking regions indicated at 88 in FIG. 1 (shown in dashed lines in FIG. 6) proximate the nose end corners of the tile 10, the thickness between the top surface 24*a* of the images 24 and the bottom surfaces 28*a* of the reinforcing ribs 28 is established at a dimension equal to the thickness between the top surface of the shelf 30, inside the alignment guides 44, and the bottom 58*a* of the stacking and positioning lugs 58, such established dimension being designated at the stacking height "H" in FIG. 9. As shown in FIG. 9, this arrangement maintains stacked tiles in parallel orientation, and thereby promotes ease of carrying in a stacked condition, and ease of stacking and shipping with a low profile support provided under the nose end 16 of the bottom tile.

A composite slate-image ridgecap trim piece 100 for use with the slate tiles 10 shown in the drawings in FIGS. 13-17. The trim piece is provided with two connected side walls 102 set at an appropriate angle therebetween for the roof grade, such as, for example, 90 degrees or 118 degrees. The trim pieces are molded with a substantially constant wall thickness. Side support edge formations 102*a* extend inwardly from the side walls to define support structure along the length of the sides, inwardly extending lips 106 are formed at the ends of the trim piece, and inside reinforcing ribs 108 are integrally molded between the sides across the connection therebetween. In the embodiment shown, the side walls are connected with an upper, relatively narrow horizontal wall 104. The outside lower portions of the sides are tapered as shown for transitioning between the face of the sides and the bottom edges.

A positioning ridge structure 110 is formed proximate one end of the trim piece 100, extending outwardly from the side walls 102 and the connecting wall 104. The ridge 110 extends transversely with respect to the axis of the trim piece, from the top of the trim piece to proximate the bottom of the sides, and projects outwardly to a height that engages the end lip 106 formed on the inside of the exposed end of an adjacent trim piece when installed onto a roof. The ridge 110 establishes a suitable minimum length of the piece to be overlapped by an adjacent trim piece when installed on the roof, such as, for example, between approximately two to three inches, and simultaneously establishes a water barrier with the adjacent installed trim piece. Fastener locations 112 are defined in the end of the trim piece 100 that will be overlapped by an adjacent installed trim piece. The ridge 110 provides a water barrier for the fasteners, and bosses may be optionally provided surrounding the fastener locations, as discussed above, as a further barrier against water reaching the fasteners. The end piece shown also includes support ribs 114 formed along the inside of side walls 102, extending inwardly therefrom to the depth of lips 106, and located on each side of the fastener locations 112, to provide additional support when the fasteners are installed through the pieces, and to assist in resistance to wind uplift. End trim pieces similar to trim piece 100 are provided to close off the open end of a ridge. The end trim pieces are provided with one end closed, with a locating lip on the inside of the other end, with suitable fastener locations formed therein.

Briefly, a typical installation procedure for roofing tiles 10 will include preparing the roof deck with underlayment, eave metal, sealant, water and ice shields, snow guards, ridge/hip vents, flashings, vapor barriers, ridge nailers, EPDM roofing sheeting to establish a waterproof structure such as on low grade of sever condition roofs, and installation of other roofing components, as desired. The tile layout is then established. This will typically involve marking the desired horizontal spacing of the tiles with vertical chalk lines spaced at the width of the tile, (e.g., 24 inch spacing for 24 inch tiles), and securing horizontal battens vertically spaced on the roof, either approximately equally spaced for equally spaced rows of tiles, or spaced for a gradient vertical exposure between rows of tiles, with the maximum spacing at the maximum vertical exposure for the configuration roof tile 10 (e.g., 10 inches), and securing hip/ridge trim nailers along the ridges of the roof. For tiles to be installed directly onto the roof deck without battens, the vertical spacing for the rows of tiles will be marked on the roof deck. The tiles are secured to the battens (or to the roof deck), one row at a time, in a random pattern, and the roof is finished by securing trim pieces to the hip/ridge nailers, and applying adhesive/sealant as required for the roof configuration.

The tiles 10 are generally positioned on a horizontal batten 142, with the positioning lugs 58 engaging the top side of the batten (see FIG. 10), to obtain approximately uniform vertical positioning and exposure of the tiles. The tiles are secured to the batten with fasteners through the fastener locations 40. As required, the tiles are cut with a saw to fill non-rectangular spaces prior to being secured to the battens. The tiles may be secured to the battens with either nails, or threaded fasteners for optimum resistance to wind uplift. The tiles are secured from right to left on the roof for the tile configuration shown, beginning with the row of tiles at the bottom of the roof structure, and progressing row-by-row up the roof. To achieve a staggered layout between rows, one row begins with a full-size (width) tile, and the next row begins with a tile that is cut vertically along the starter alignment guide 46 at the center of a tile image to obtain a reduced-width tile. With a first row of tiles in position on the roof, the tiles of the next row are easily positioned by simply aligning the edge of the tile with a half-joint alignment guide 46 on the tile therebelow. The self-centering channel waterlock interface assists to ensure that adjacent tiles are properly positioned. To achieve further random, staggered pattern, the notch 50 enables selected tiles to be secured to the battens in a slightly raised vertical position, at different vertical exposures such as shown and designated V1-3 in FIGS. 10A-C.

Further installation and other details are shown and described in the VANDE HEY-RALEIGH MFG., INC. "LIGHTWEIGHT SLATE—INSTALLATION AND SPECIFICATION MANUAL", 10-2002, attached hereto and made a part hereof by specific reference thereto.

As further illustration of an alternate embodiment of the present invention, the tiles 10 can be formed in a Double/Spanish-S tile configuration not shown. To implement the present invention with these images in an alternate embodiment, the Double/Spanish-S tile images are formed in the rectangular image section 14 of tiles similar to tiles 10 in place of the slate images 24 therein. In this instance, the open end trim pieces are provided with a curvature complimentary to the tiles as shown. Positioning/water dam ridges are provided spaced from one end, lips for engaging the positioning ridges are formed on the curvature longitudinally proximate the positioning ridges for engaging therewith, and fastener locations are provided in the ends to be overlapped. The closed-end trim piece shown is similarly provided with a positioning ridge and fastener locations for connecting to the nailers. Additional images of any desired configuration, such as shake images, may be presented in the image section 14 of the tile 10.

We claim:

1. A molded composite roofing tile with a front and a back, a top and bottom, and opposite outer sides; the tile comprising: a) an image section with a plurality of tile or shingle images having (1) backsides raised from a datum plane, (2) a substantially constant front-to-back thickness, (3) bottom edges that establish the bottom of the image section, and (4) outer sides that establish opposite outer sides of the image section;

b) the back of said image section having (1) support surfaces at said datum plane, and (2) spaced, non-straight reinforcing ribs extending rearwardly to no further than said datum plane; wherein each of the ribs are comprised of a plurality of angularly related line segments and no one rib configuration repeats;

d) a head lap with (1) an upper waterlock along the top of the image section, the upper waterlock being configured to resist flow of water over the top thereof and for controlled water flow therefrom, (2) laterally spaced fastener-receiving formations, and (3) fastener-supports extending rearwardly to said datum;

e) a side water lock along one of said outer sides of the image section; and f) a side overlap facing rearwardly along the other of said outer sides of the image section, the side overlap being configured for positioning into the side waterlock of an adjacent tile when installed onto a roof.

2. The roofing tile as defined in claim 1 in which (a) the side waterlock terminates at a closed upper end proximate the top of the head lap and an open lower end proximate but above the bottom of the image section, and (b) the side overlap terminates at a closed lower end that is adapted to overlap the lower open end of the side waterlock on an adjacent tile and an open upper end below the upper closed end of the side waterlock for adjustable top-to-bottom positioning of the side waterlock and side overlap of adjacent installed tiles, and thus for adjustable exposure of the images of said tiles when installed onto a roof.

3. The roofing tile as defined in claim 1 further comprising laterally aligned tile-positioning lugs extending rearwardly from the back of the head lap to beyond said datum plane for guided positioning of the roofing tiles onto laterally extending battens on a roof.

4. The roofing tile as defined in claim 1 in which the side waterlock and side overlap are configured to establish side-to-side self-centering adjustment between adjacent tiles when installed onto a roof.

5. The roofing tile as defined in claim 1 in which the upper water lock includes an upper dam and a side dam on the side of the overlap, a lower water-guide for draining onto the image section, and an open side opposite the side dam for draining into the side waterlock.

6. The roofing tile as defined in claim 1 in which (a) the head lap includes a shelf along the length thereof, and (b) the fastener-receiving formations are raised from said shelf to separate fastener therein from water that may be on the shelf.

7. The roofing tile as defined in claim 1 in which the fastener-receiving formations are provided with tapered counter-sunk holes to establish a snug fit with correspondingly sized tapered heads of fasteners used to secure the tile to a roof.

8. A molded composite roofing tile with a front and a back, a top and bottom, and opposite outer sides; the tile comprising:

a) an image section with (1) a plurality of tile or shingle images having (i) bottom edges that establish the bottom of the image section, and (ii) outer sides that establish opposite outer sides of the image section, and (2) a visually distinct divider extending adjacent each of the Images;

b) the back of said image section having (1) support surfaces at said datum plane, and (2) spaced, non-straight reinforcing ribs extending rearwardly to no further than said datum plane; wherein each of the ribs are comprised of a plurality of angularly related line segments and no one rib configuration repeats;

c) a head lap with (1) an upper waterlock along the top of the image section, the upper waterlock being configured to resist flow of water over the top thereof and for controlled water flow therefrom, (2) laterally spaced fastener-receiving formations, and (3) fastener supports extending rearwardly to said datum plane;

d) a side water lock along one of said outer sides of the image section; and e) a side overlap facing rearwardly along the other of said outer sides of the image section, the side overlap being configured for positioning into the side waterlock of an adjacent tile when installed onto a roof.

9. The roofing tile as defined in claim 8 in which (a) the side waterlock terminates at a closed upper end proximate the top of the head lap and an open lower end proximate but above the bottom of the image section, and (b) the side overlap terminates at a closed lower end is adapted to overlap the lower open end of the side waterlock on an adjacent tile and an open upper end below the upper closed end of the side waterlock for adjustable top-to-bottom positioning of the side waterlock and side overlap of adjacent installed tiles, and thus for adjustable exposure of the images of said tiles when installed onto a roof.

10. The roofing tile as defined in claim 8 further comprising laterally aligned tile-positioning lugs extending rearwardly from the back of the head lap to beyond said datum plane for guided positioning of the roofing tiles onto laterally extending battens on a roof.

11. The roofing tile as defined in claim 8 in which the side waterlock and side overlap are configured to establish side-to-side self-centering adjustment between adjacent tiles when installed onto a roof.

12. The roofing tile as defined in claim 8 in which the upper water lock includes an upper dam and a side dam on the side of the overlap, a lower water-guide for draining onto the image section, and an open side opposite the side dam for draining into the side waterlock.

13. The roofing tile as defined in claim 8 in which (a) the head lap includes a shelf along the length thereof, and (b) the fastener-receiving formations are raised from said shelf to separate fasteners therein from water that may be on the shelf.

14. The roofing tile as defined in claim 8 in which the fastener-receiving formations are provided with tapered counter-sunk holes to establish a snug fit with correspondingly sized tapered heads of fasteners used to secure the tile to a: roof.

15. A molded composite roofing tile with a front and a back, a top and bottom, and opposite outer sides; the tile comprising:

a) an image section with (1) a plurality a tile or shingle images having (a) backsides raised from a datum plane (b) a substantially constant front-to-back thickness, (c) bottom edges that establish the bottom of the image section, and (d) outer sides that establish opposite outer sides of the image section, and (2) a visually distinct divider extending adjacent each of the images from proximate the top of the images to proximate but above the bottom edges;

b) the back of said image section having (1) support surfaces at said datum plane, and (2) spaced, non-straight reinforcing ribs extending rearwardly to no further than said datum plane; wherein each of the ribs are comprised of a plurality of angularly related line segments and no one rib configuration repeats;

c) a head lap with (1) an upper waterlock along the top of the image section, the upper waterlock having (a) a shelf extending along the length thereof, (b) an uninterrupted upper dam to resist flow of water over the top of the shelf, (c) an uninterrupted side dam to resist flow of water out one side of the shelf, the opposite side of the shelf being open for outflow of water from the shelf, and (d) an interrupted lower dam for controlled flow of water out the bottom of the shelf toward the image section therebelow, (2) laterally spaced fastener-receiving formations proximate the lower dam, the fastener-receiving formations having pre-formed tapered fastener openings and being raised from the shelf to resist water flow into said openings, and (3) fastener supports extending from the back of the shelf to said datum plane;

d) a side water lock along one of said outer sides of the image section, the side waterlock having a forwardly facing channel substantially along the length thereof from the open side of the shelf to proximate but above the bottom of the image section; and e) a side overlap facing rearwardly along the other of said outer sides of the image section, the side overlap being configured for side-to-side adjustable positioning into the side waterlock channel of an adjacent tile when installed onto a roof, the channel and side overlap further having complimentary profiles to establish side-to-side self-centering between adjacent installed tiles.

16. The roofing tile as defined in claim 15 in which (a) the side waterlock terminates at a closed upper end proximate the top of the head lap and an open lower end proximate but above the bottom edge formations of the image section, and (b) the side overlap terminates at a closed lower end that is adapted to overlap the lower open end of the side waterlock on an adjacent tile and an open upper end below the upper closed end of the side waterlock for adjustable top-to-bottom positioning of the side waterlock and side overlap of adjacent installed tiles, and thus for adjustable exposure of the images of said tiles when installed onto a roof.

17. The roofing tile as defined in claim 15 further comprising laterally aligned tile-positioning lugs extending rearwardly from the back of the head lap to beyond said datum plane for guided positioning of the roofing tiles onto laterally extending battens on a roof.

18. The roofing tile as defined in claim 17 further comprising tile stacking guides formed in the head lap to receive the tile-positioning lugs of a second roofing tile stacked thereon.

19. The roofing tile as defined in claim 15 in which the side waterlock channel is formed with outwardly sloping sides to establish said side-to-side self-centering between adjacent installed tiles.

20. The roofing tile as defined in claim 15 in which the front and back of the image section are provided with aligned stacking regions that are spaced at an equal front-to-back distance from one another and separated top-to-bottom and side-to-side from one another for positioning back stacking regions of a first tile onto front stacking surfaces of a second tile stacked thereon.

* * * * *